US006328530B1

(12) United States Patent
Kato et al.

(10) Patent No.: US 6,328,530 B1
(45) Date of Patent: Dec. 11, 2001

(54) MG ALLOY MEMBER AND ITS USE

(75) Inventors: Tomoya Kato; Takeshi Obana, both of Hitachi; Mitsuyoshi Shouji, Ibaraki-ken; Kazumi Fujii, Hitachi; Kenya Ohashi, Hitachinaka, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/261,963

(22) Filed: Mar. 3, 1999

(30) Foreign Application Priority Data

Mar. 18, 1998 (JP) ..... 10-068114

(51) Int. Cl.[7] ..... F04D 29/02; F04D 29/44

(52) U.S. Cl. ..... 415/200; 415/208.3; 416/186 R; 416/241 R; 428/421; 428/422; 428/469; 148/243; 148/275; 359/819

(58) Field of Search ..... 415/200, 206, 415/208.3, 211.1, 211.2; 416/186 R, 213 R, 241 R; 428/421, 422, 469; 148/243, 275; 359/819

(56) References Cited

U.S. PATENT DOCUMENTS

| | | | | |
|---|---|---|---|---|
| 1,947,122 | | 2/1934 | Burdick et al. . | |
| 3,127,279 | | 3/1964 | Baig et al. . | |
| 3,791,942 | * | 2/1974 | McNeill | 205/318 |
| 3,797,723 | * | 3/1974 | Perkins et al. | 227/109 |
| 3,899,366 | | 8/1975 | Tajkowski . | |

(List continued on next page.)

FOREIGN PATENT DOCUMENTS

| | | | |
|---|---|---|---|
| 707722 | | 7/1941 | (DE) . |
| 19702953 | | 7/1998 | (DE) . |
| 0839931 | | 6/1998 | (EP) . |
| 0890745 | | 1/1999 | (EP) . |
| 302943 | | 12/1928 | (GB) . |
| 4180594 | * | 6/1992 | (JP) . |
| 7-504942 | * | 6/1995 | (JP) . |
| 407202083 | * | 8/1995 | (JP) . |
| 9-176894 | * | 7/1997 | (JP) . |
| 9-228062 | * | 9/1997 | (JP) . |
| 411082381 | * | 3/1999 | (JP) . |
| 1072979 | * | 2/1984 | (RU) . |
| 10278 | | 5/1993 | (WO) . |

OTHER PUBLICATIONS

Patent Abstracts of Japan, vol. 008, No. 102 (C–222), May 12, 1984 & JP 59 016997 A Jan. 28, 1984.

Chemical Abstracts, vol. 95, No. 24, Dec. 14, 1981 "Surface Treatment of Magensium and its Alloys" p. 549; col. left, & JP 56 098495, Aug. 7, 1981.

Patent Abstracts of Japan, vol. 015, No. 285 (C–0851), Jul. 19, 1991 & JP 03 100182 A Apr. 25, 1991.

Anonymous: "Magnesium the Winner in Computer Housing Cost Study", Modern Metals, vol. 40, No. 1, Feb. 1, 1984, pp. 29–33.

Higuchi, K.: "Closed Loop Recycling of Magnesium PC Housing" IEEE International Symp.: Electron Environ. May 1, 1996, pp. 102–108, Dallas.

*Primary Examiner*—Christopher Verdier
(74) *Attorney, Agent, or Firm*—Antonelli, Terry, Stout & Kraus, LLP

(57) ABSTRACT

A Mg alloy member with an anticorrosive coating free from any enviromental load can be produced by using a solution for chemical conversion treatment for anticorrosive coating, which comprises 0.05 to 1 mol/l of an oxoacid compound of heavy metal selected from Mo, W and V and has a pH of 2 to 6 adjusted by sulfuric acid or nitric acid, and is characterized by contacting the surface of Mg alloy preferably containing 2 to 10% Al with the solution, thereby forming a specific oxide film and, if necessary further forming a fluorine-containing organic film on the film, the resulting Mg alloy member being used in electrically driven blowers, note-type personal computers, various household electrical appliances, etc.

16 Claims, 10 Drawing Sheets

U.S. PATENT DOCUMENTS 4,613,386 * 9/1986 Yates et al. ..... 148/13
4,668,347 * 5/1987 Habermann et al. ..... 204/33
5,237,486 8/1993 Lapointe et al. .
5,531,950 * 7/1996 Kinura et al. ..... 264/135
5,756,218 * 5/1998 Buchheit et al. ..... 428/469
5,979,541 * 11/1999 Saito ..... 165/80.3
6,146,094 * 11/2000 Obana et al. ..... 415/200

* cited by examiner

DISPLAY COVER

DISPLAY CASE

PALMREST

BOTTOM CASE

MG ALLOY MEMBER AND ITS USE

BACKGROUND OF THE INVENTION

The present invention relates to a process for forming a novel anticorrosive coating on Mg alloy, to an MG alloy member and household electrical appliances, audio systems, etc. using materials with such an anticorrosive coating, and more particularly to a Mg alloy member having a good corrosion resistance given by an environmentally harmless chemical conversion treatment, its use, a solution for chemical conversion treatment and a process for anticorrosive coating.

Mg alloy materials have the lightest weight among the practical metallic materials and also have a large specific strength and a good castability, and thus their wider application to cases, structural bodies, various parts, etc. of household appliances, audio systems, aircrafts, automobiles, etc. has been desired. Particularly, Al-containing AZ91D (Al: 8.3–9.7wt. %) and AM60B (Al: 5.5–6.5 wt. %) have a good fluidity in die casting and thixo molding and thus are most desirable alloys.

However, Mg has the basest normal electrode potential among the practical metallic materials, resulting in a high corrosion susceptibility when the metal is brought into contact with other metals and a considerably poor anticorrosiveness in an aqueous acidic, neutral or chloride solution. Thus, for its application to corrosion-excluding positions, e.g. good appearance-maintaining positions etc., it is necessary to provide an anticorrosive treatment. Coating is the most popular anticorrosion means, but it is hard to apply coating to Mg alloy materials per se because of the disadvantage that the resulting coating film, even if obtained has a poor adhesiveness. Sometimes, corrosion may occur under the coating film, and thus it is the ordinary practice to conduct a substrate surface treatment in advance of the coating process.

The substrate surface treatment technology includes, for example, substrate surface treatments of forming a metal oxide film or a sparingly soluble salt film by chemical conversion treatment or anodizing using such heavy metal oxo acid salts as chromates, permanganates etc., or phosphates so as to improve the corrosion resistance and the adhesiveness of coating films.

It is also the ordinary coating practice to use oil paints and synthetic resin paints which contain lead compounds, zinc powder and its compounds, chromates, etc. as an anticorrosive pigment.

Processes for forming an anticorrosive film on a Mg alloy are disclosed in JP-A-9-176894 and JP-A-9-228062.

Surface treatments using specific chemical compounds such as chromates, permanganates, etc. however have problems relating to environmental friendliness, such as effluent water pollution problems and skin allergy problems to operators. The use of such surface treatments is increasingly subject to strict regulations. Phosphates are also more or less harmful to the environment, and the corrosion resistance of resulting phosphate films is not satisfactory. Substitute processes for such substrate surface treatments are now under development but still have problems with respect to corrosion resistance, etc.

Lead compounds or chromates contained as anticorrosive pigments in coating technology also have problems relating to environmental friendliness. Furthermore, there are occasionally problems relating to corrosions probably due to diffusion of oxygen or water generated by corrosion under the coating film or by coating film defects.

The invention disclosed in said JP-A-9-176894 relates to an electrolytic treatment. Anodizing requires a power source of high voltage. An entirely uniform film is also hard to obtain. In the invention disclosed in said JP-A-9-228062, treatments using an organometal are highly reactive and thus an entirely uniform film is likewise hard to obtain.

BRIEF SUMMARY OF THE INVENTION

An object of the present invention is to provide a Mg alloy member having a chemical conversion film with a good corrosion resistance obtained by using an evironmentally harmless aqueous solution, its use, a solution for the chemical conversion treatment and its process.

Another object of the present invention is to form a super-water-repellent film on the chemical conversion film.

The present invention provides a Mg alloy member comprising a Mg alloy and formed thereon an oxide film comprising 15 to 35% by atom of Mg and 5 to 2% by atom of Mo, and if necessary 30% by atom or less of Al or a metallic Al-containing oxide film.

The present invention also provides a Mg alloy member comprising a Mg alloy and formed thereon a noble oxide film having a corrosion potential of −1,500 mV or more in 1 M-$Na_2SO_4$ and 0.01 M-$Na_2B_4O_7$ (pH 9.18).

The present invention further provides a Mg alloy member comprising a Mg alloy and formed thereon the oxide film mentioned above or the noble oxide film mentioned above, and formed on the oxide film a fluorine-containing super-water-repellent organic film.

The present invention still further provides use of the Mg alloy member mentioned above as a blade wheel in an electrically driven blower, as a casing of a personal computer, as a casing of a video camera, cases for various electrically driven tools, a portable telephone case, a television case, automobile sheet parts, etc.

The present invention also provides a solution for chemical conversion treatment for anticorrosive coating, characterized by comprising 0.05 to 1 M of a heavy metal oxo acid compound comprising at least one of heavy metal atoms selected from Mo, W and V in terms of the heavy metal atom and having a pH of 2 to 6 adjusted by sulfuric acid or nitric acid.

The present invention further provides a process for producing a Mg alloy member, characterized by contacting a Mg alloy with an aqueous acidic solution containing a heavy metal oxo acid compound of at least one of heavy metals selected from Mo, W and V, thereby forming an oxide film on the surface of the Mg alloy.

DETAILED DESCRIPTION OF THE INVENTION

Figure 1:
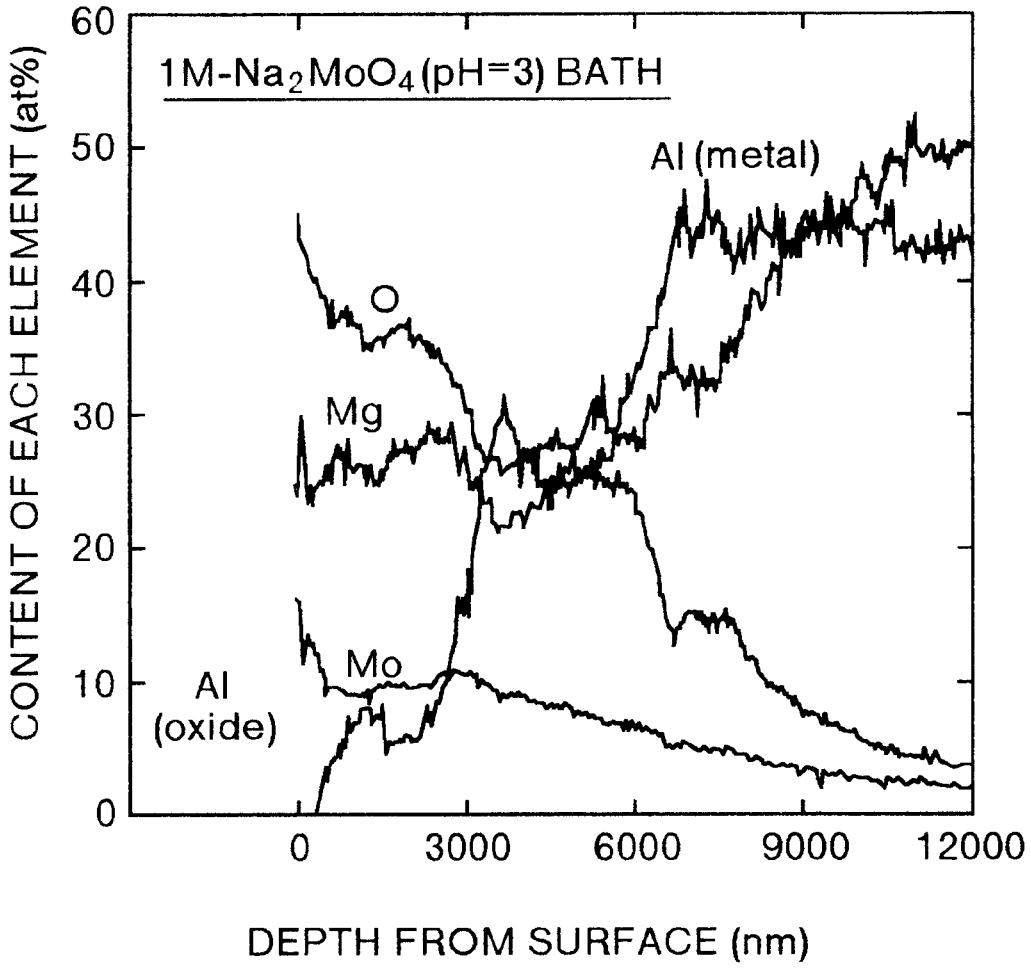
FIG. 1 is a profile showing components in the AES depth direction of the present chemical conversion film.

The present invention provides a Mg alloy member, characterized in that the Mg alloy member has, on the surface, an oxide film comprising 15 to 35%, preferably 20 to 30%, of Mg by atom and 5 to 20% of Mo by atom; an Al-containing oxide film comprising 15 to 35% of Mg by atom, 5 to 20% of Mo by atom and not more than 30%, preferably 10 to 25%, of Al by atom; an oxide film comprising 15 to 35% of Mg by atom, 5 to 20% of Mo by atom, 10 to 30% of Al as an oxide and not more than 15%, preferably 4 to 12%, of metallic Al by atom; a noble oxide film with a corrosion potential of not less than −1,500 mV, preferably not less than −1,400 mV, after immersion in an aqueous 0.01 M $Na_2B_4O_7$ solution at a pH of 9.18 and 25° C. for 30 minutes; or a noble oxide film with a corrosion potential of not less than −1,500 mV, preferably not less than −1,400 mV, after immersion in an aqueous 1 M $Na_2SO_4$ solution at 25° C. for 15 minutes.

Furthermore, the present invention provides a Mg alloy member, characterized in that the Mg alloy member has the oxide film or a specific oxide film and a fluorine-containing super-water-repellent organic film on the film.

The fluorine-containing film is preferably a film comprising a compound of the following general formula (1) and an organic polymer:

$$\text{Rf-A-X-B-Y} \quad (1)$$

wherein Rf is a perfluoropolyoxyalkyl group or a perfluoroalkyl group; A and B are independently an amido group, an ester group or an ether group;

X represents any one of 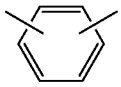 ,

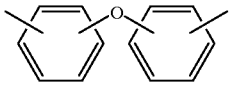 ,

-continued

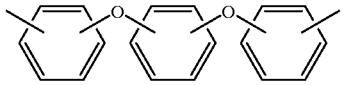 ,

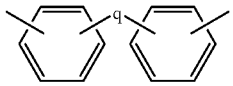

and

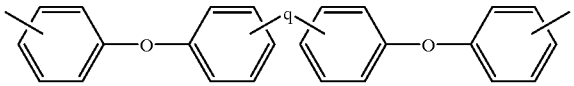

(q is $—CH_2—$, 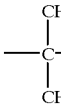 , 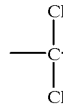 , $—S—$, $—SO_2—$ or direct bond); and Y represents

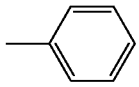

or

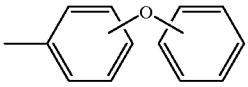 .

In the definition of Rf, the perfluoro-polyoxyalkyl group is preferably represented by the formula: $(C_nF_{2n}—O)_x—$, wherein n is preferably an integer of 1 to 3: and x is preferably an integer of 5 to 70, and the perfluoroalkyl group is preferably represented by the formula: $F—C_mF_{2m}—$, wherein m is preferably an integer of 3 to 12.

The fluorine-containing film is preferably a film comprising a compound of the following general formula (2):

$$\text{Rf-A-R-Si}—(—OC_nH_{2n+2})_2 \quad (2)$$

wherein Rf is a perfluoropolyoxyalkyl group or a perfluoroalkyl group as defined above; A is an amido group, an ester group or an ether group; R is an alkylene group; and n is 1 or 2.

The perfluoropolyoxyalkyl group preferably has a chain of repetition units of oxyalkylene represented by the following structural formula (3), (4) or (5) alone or in combination:

$$—(—CF_2—O—)— \quad (3)$$

$$—(—C_2F_4—O—)— \quad (4)$$

$$—(—C_3F_6—O—)— \quad (5)$$

Examples of specific structure of the general formula (1) include the following structures of (formula 1) to (formula 8):

(formula 1)

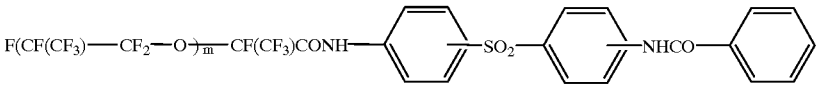

(formula 2)

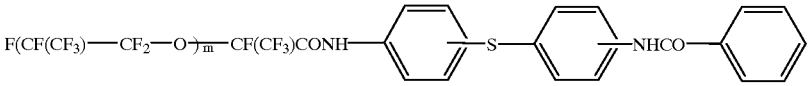

-continued (formula 3)

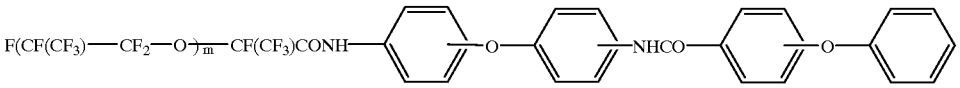

(formula 4)

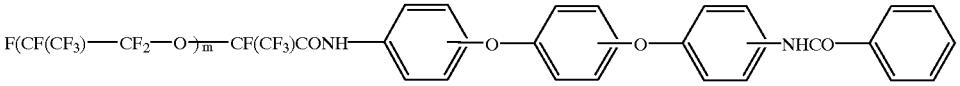

(formula 5)

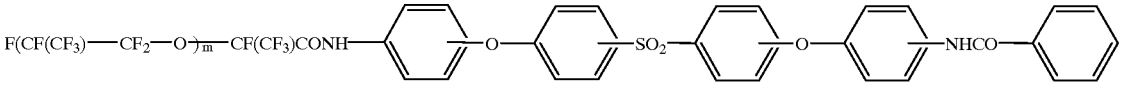

(formula 6)

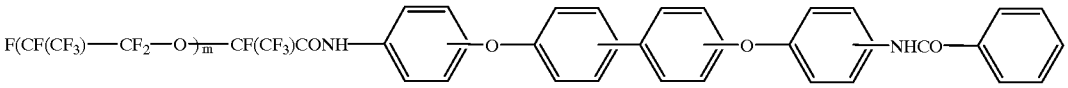

(formula 7)

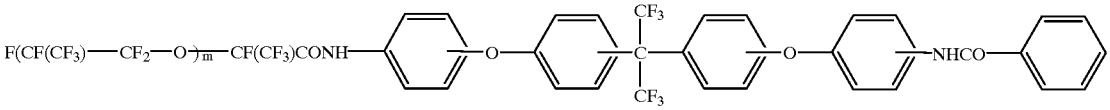

(formula 8)

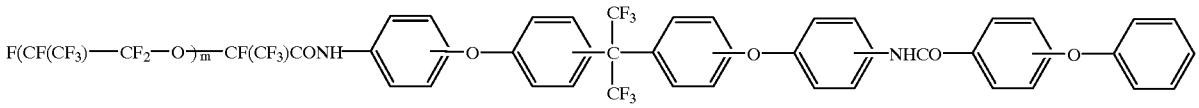

(wherein m is 14 on average).

Examples of specific compounds of the general formula (2) include the following structures of (formula 9) to (formula 14).

$F(CF_2—CF_2—CF_2—O—)—_nCF_2—CF_2CONH—CH_2CH_2CH_2—Si(—OCH_2CH_3)_3$ (formula 9)

$F(CF_2—CF_2—CF_2—O—)—_n—CF_2CONH—CH_2—NH—CH_2CH_2—CH_2—Si(—CH_3)(—OCH_3)_2$ (formula 10)

$CF_3—CF_2—CF_2—CF_2—CF_2—CF_2—CF_2—CONH—CH_2CH_2CH_2—Si(—OCH_2CH_3)_3$ (formula 11)

$F(CF_2—CF_2CF_2—O)—_n—CF_2CF_2CH_2—O—CH_2CH_2CH_2—Si(—OCH_3)_3$ (formula 12)

$F(CF_2—CF_2—CF_2—O—)—_n—CF_2—CF_2COO—CH_2CH_2—Si(—OCH_3)_3$ (formula 13)

$CF_3—CF_2—CF_2—CF_2—CF_2—CF_2—CF_2—COO—CH_2CH_2CH_2—Si(—OCH_3)_3$ (formula 14)

(wherein n is 21 on average)

The present invention provides an electrically driven blower which comprises a motor encased in a housing a blade wheel fixed to the rotating shaft of the motor, stationary guide blades provided against the flow passage end of the blade wheel and a fan casing housing the blade wheel and the stationary guide blades, characterized in that the blade wheel is composed of the above-mentioned Mg alloy member having an oxide film on the surface.

Furthermore, the present invention provides an electrically driven blower which comprises a motor encased in a housing, a blade wheel fixed to the rotating shaft of the motor, stationary guide blades provided against the flow passage end of the blade wheel and a fan casing housing the blade wheel and the stationary guide blades, characterized in that the blade wheel comprises a front plate, a back plate counterposed to the front plate and a plurality of blades provided between the front plate and the back plate, at least one of the front plate and the back plate being integrated with the blades, and is composed of a Mg alloy member having an oxide film on the surface.

The blade plate is composed of the above-mentioned Mg alloy member.

Furthermore, the present invention provides a personal computer, a video camera, a single-lens reflex camera, a compact camera, an MD player, an HDD, an automobile, a television, a portable telephone and an electrically driven tool, characterized by using a case, etc. composed of a Mg alloy member having the above-mentioned oxide film on the surface or further a super-water-repellent, fluorine-containing organic film on the oxide film.

The present invention provides a solution for chemical conversion treatment for anticorrosive coating, characterized by comprising 0.05 to 1 M (mol/l of a heavy metal oxo acid compound comprising at least one of heavy metal atoms selected from Mo, W and V in terms of the heavy metal atom and having a pH of 2 to 6 adjusted by sulfuric acid or nitric acid.

The present invention provides a process for producing a Mg alloy member, characterized by contacting a Mg alloy with an aqueous acidic solution containing a heavy metal oxo acid compound of at least one of heavy metals selected from Mo, W and V, thereby forming an oxide film on the surface of the Mg alloy.

That is, in the present invention, an aqueous solution containing 0.05 to 1 mol/l of a heavy metal oxo acid compound comprising at least one of heavy metal atoms selected from Mo, W and V in terms of heavy metal atom and having a pH of 2 to 6 adjusted by sulfuric acid or nitric acid is brought into contact with the surface of preferably Al-containing Mg alloy, thereby conducting a chemical conversion treatment of the Mg alloy, followed by water washing and drying, to form the above-mentioned oxide film. It is preferable to form a compound oxide film containing the above-mentioned heavy metal atom and Al, or a compound oxide film, where the Al cation fraction is at least three times as large as the Al content of the substrate, or a compound oxide film where the heavy metal atom is in a polyvalent state. It is preferable that the Al-containing alloy contains 2 to 10 wt. % Al.

The amount of the heavy metal oxo acid compound in the solution for chemical conversion treatment is 0.05 to 1 mol/l in terms of heavy metal atom so as to retain cations of heavy metal atom in the chemical conversion film. Below 0.05 mol/l, the chemical conversion film will be hardly formed, whereas above 1 mol/l, it will be saturated. A range of 0.2 to 0.5 mol/l that can ensure formation of a good film is desirable. The pH of the solution for chemical conversion treatment is preferably in a range of 2 to 6, so that the Al-containing Mg alloy can be brought into a readily reactable, active state to form a good film. Below 2, melting of the substrate will be too vigorous to form a chemical conversion film, whereas above 6, the reaction rate to form a film, which follows the melting of substrate, will be lower. To form a better film, a pH range of 2.5 to 4 is more desirable. Time for chemical conversion treatment is preferably in a range of 5 to 300 seconds. Below 5 seconds, a satisfactory film will fail to grow, whereas above 300 seconds its effect will be saturated. To form a better film, a range of 30 to 200 seconds is more desirable. Water washing following the chemical conversion treatment must be continued until no bubbles generate from the chemical conversion film. An aqueous solution of a weak base such as $Na_2B_4O_7$, $Na_2CO_3$ or the like may be substituted for water. Drying can be natural drying, but may be drying in a temperature range of 20° C. to 80° C.

Furthermore, the present invention provides further coating of the chemical conversion film to improve the corrosion resistance or to form a fluorine-containing, super-water-repellent film on the chemical conversion film after the substrate surface treatment.

The fluorine-containing film preferably comprises a film of the thermosetting silicone resin, etc. as the major component and a layer of a fluorine-based compound of the foregoing general formula (1) or (2) formed on the surface of the film or a single film of the fluorine-based component of the general formula (2) without the organic polymer film. Three specific procedures for coating the fluorine-containing film will be given below: (I) An organic polymer material and a fluorine-based compound of the general formula (1) are dissolved into an organic solvent to prepare a coating material. The chemical conversion film surface is immersed into the coating material and then picked up, followed by heating to the polymer heat curing temperature. By the treatment, the perfluoropolyoxyalkyl group or perfluoroalkyl group of the general formula (1) is fixed to the polymer surface layer. (II) An organic polymer material is dissolved into an organic solvent to prepare a coating material. The chemical conversion film surface is immersed into the coating material and then picked up, followed heating to the by polymer heat curing temperature to form a polymer film on the surface. Then, the polymer film-formed surface is immersed into a solution containing a fluorine-based compound of the general formula (2) as dissolved therein, and then picked up, followed by heating at 150 for 10 minutes. By the treatment, the fluorine-based compound of the general formula (2) is fixed to the polymer surface by chemical reaction. (III) To prepare a fluorine-containing single film composed of a fluorine-based compound of the general formula (2) without the organic polymer film, the chemical conversion film surface is washed to remove the oil and fat matters therefrom, and is immersed into a solution containing a fluorine-based compound of the general formula (2), which chemically reacts with the substrate surface and is fixed thereto.

Examples of specific structural formulae of the general formula (1) are those given by (formula 1) to (formula 8).

Examples of specific structural formulae of the general formula (2) are those given by (formula 9) to (formula 14).

Organic polymers for use in the present invention are those which can be used as a coating material to form a coating film having the required mechanical strength. For example, epoxy resin, phenol resin, polyimide resin, silicone resin, etc. are desirable as thermosetting polymers.

According to the present invention, a metallic material can be coated with a film having a distinguished corrosion resistance without using enviromental harmful materials. Furthermore, a material with a large area can be coated at relatively low temperatures.

Its principle and process will be described in detail below.

Usually, the anticorrosive coating to metallic materials has micron-size defects or sometimes may be damaged due to external factors, etc. Corrosion proceeds due to such defects. When an oxide film, such as a chromate film containing both hexavalent and trivalent Cr ions, is formed and exists, an anodic reaction to dissolve the substrate metal through the micron-size defects takes place and also a cathodic reaction to reduce the hexavalent Cr ions to the trivalent Cr ions in the surrounding oxide film takes place at the same time.

$M \rightarrow M^{n+} + ne$: anodic reaction $Cr^{6+} + 3e \rightarrow Cr^{3+}$: cathodic reaction By these reactions a $Cr_2O_3$ film having new $M^{7+}$filled in the film defects is formed, so that the resulting chromate film show a distinguished corrosion resistance with a defect-remedying action.

$MoO_4^{2-}$, $WO_4^{2-}$, $VO_4^{3-}$and $VO_3^{-}$can be also used as a passivating agent or an anodic inhibitor and can suppress corrosion of metallic materials, when put into the corrosive circumstances in a small amount. Its mechanism is shifting the corrosion potential to a nobler level by a few hundred mV and facilitation to form an oxide film showing a high corrosion resistance so called "passivation film" on the substrate surface. That is, the passivating agent has a specific property of being rapidly reduced by a cathode current and thus can be preferentially adsorbed onto the metallic substrate surface.

Inclusion of two kinds of valency such as $MoO_3$ and $MoO_2$, etc. has the same effect as that of the chromate film.

A film of oxide and/or hydroxide and/or oxyhydroxide containing metal ions having a plurality of valencies can be formed by providing a metallic material with an aqueous $H_2O_2$ solution prepared by dissolving metal and/or metal carbonate composed of at least one of Mo, W and V and removing excess $H_2O_2$ therefrom by decomposition, followed by heat treatment at a temperature of not more than 80° C. to effect dehydration and stabilization.

Alternatively, a film of oxide and/or hydroxide and/or oxyhydroxide containing metal ions having a plurality of valencies can be formed according to a process for immersing a metallic material into a solution containing at least one of $MoO_4^{2-}$, $WO_4^{2-}$, $VO_4^{3-}$and $VO_3$_and/or according to a process for electrochemically anodizing a metallic material in a solution containing at least one of $MoO_4^{2-}$, $WO_4^{2-}$, $VO_4^{3-}$and $VO_3^-$, and the film is heat treated at a temperature of not more than 80° C. to effect dehydration and stabilization, and then a fluorine-containing film is formed on the surface.

Alternatively, a film of oxide and/or hydroxide and/or oxyhydroxide containing metal ions having a plurality of valencies can be formed according to a reactive sputtering process, and a fluorine-containing film is formed on the film.

Alternatively, a film of oxide and/or hydroxide and/or oxyhydroxide containing metal ions having a plurality of valencies can be formed by providing a metallic material with an aqueous $H_2O_2$ therefrom by decomposition, followed by heat treatment at a temperature of not more than 80° C. to effect dehydration and stabilization, and a fluorine-containing film is formed on the surface in the same manner as above.

According to the present invention, it is preferable to form the above-mentioned oxide film as an undercoat and further form a coat having the ordinary corrosion resistance or various color tones showing a proper appearance on the surface of the film.

The present invention is illustrated by way of the following Examples.

Example 1, Comparative Example 1–3

Table 1 shows the composition of aqueous solutions for forming an oxide film on the surfaces of Mg alloys used in Run Nos. 1 to 6 of the present invention and Comparative Examples 1 to 3 and conditions for chemical conversion treatment.

TABLE 1

| | |
|---|---|
| Run No. 1 | 1M-$Na_2MoO_4$ (with $H_2SO_4$ to make pH = 3.0) 60° C., 180 sec. |
| Run No. 2 | 0.5M-$Na_2MoO_4$ (with $H_2SO_4$ to make pH = 3.0) 60° C., 180 sec. |
| Run No. 3 | 0.1M-$Na_2MoO_4$ (with $H_2SO_4$ to make pH = 3.0) 60° C., 180 sec. |
| Run No. 4 | 1M-$Na_2MoO_4$-0.5M-NaF(with $H_2SO_4$ to make pH = 3.0) 60° C., 180 sec. |
| Run No. 5 | 0.5M-$Na_2MoO_4$-0.5M-NaF(with $H_2SO_4$ to make pH = 3.0) 60° C., 180 sec. |
| Run No. 6 | 0.1M-$Na_2MoO_4$-0.5M-NaF(with $H_2SO_4$ to make pH = 3.0) 60° C., 180 sec. |
| Comp. Ex. 1 | $Na_2Cr_2O_7$180 g/1, $HNO_3$(60 wt %) 260 ml/1, 30° C., 120 sec. (chromate: one species) |
| Comp. Ex. 2 | $Na_2Cr_2O_7$180 g/1, $HNO_3$(60 wt %)84 ml/1, F15 g/l, $Al_2(SO_4)_3$10 g/l, 20° C., 180 sec. |
| Comp. Ex. 3 | 0.05M-$Na_2MoO_4$-0.15M-$H_3PO_4$ (to make pH = 2.0) 60° C. 180 sec. |

In Run Nos. 1–6 and Comparative Examples, AZ91D (Mg alloy diecasting material containing 9 wt. % Al and 1 wt. % Zn, 10×10×50 mm) was used as test pieces.

In this Example, oxide films were formed by immersion into solution for chemical conversion treatment of Table 1. As a pretreatment, the test pieces were polished to #2,000 with SiC paper and then defatted in acetone by ultrasonic washing. The test pieces were subjected to chemical conversion treatment under conditions given in Table 1 and then immediately washed with water and dried in air. In the table, M means a molar concentration, temperature (°C.) is a temperature of solution for chemical conversion treatment, and time (sec.) is an immersion time.

By immersing the Mg alloy into solutions for chemical conversion treatment, the surface of the alloy is colored. Thickness of the film can be anticipated from the degree of coloring. By immersion for 3 minutes, light brown turns to dark brown and further to blackish.

Figure 2:
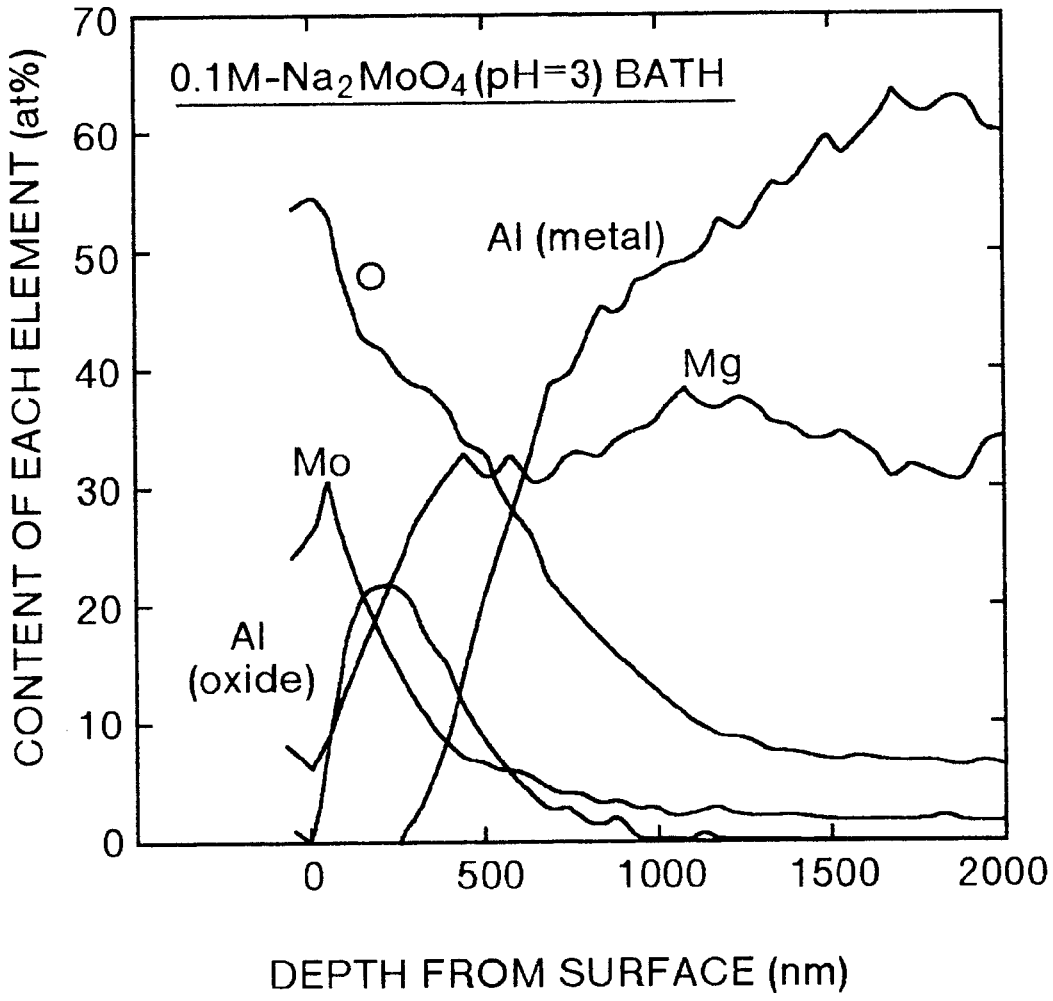
FIG. 2 is a profile showing component in the AES depth direction of the present chemical conversion film.

FIG. 1 and FIG. 2 are profile in AES depth direction of films on the alloy after chemical conversion treatment in 1 M (Run No. 1) and 0.1 M (Run No. 3) of $Na_2MoO_4$ (with $H_2SO_4$ to make pH=3.0), respectively. In both cases, it can be seen that Al contained in the substrate is enriched on the surface and Mo is incorporated into the oxide film from the solution.

As shown in FIG. 1, at a thickness ranging from 0 to 3 $\mu$m (from 0 to 3,000 nm) the oxide film has 25–30 at. % Mg (27 at. % on average), 15–22 at. % Al as an oxide (20 at. % on average), 9–12 at. % Mo (10 at. % on average), 0–17 at. % Al as metal (6 at. % on average), 30–42 at. % O (37 at. % on average), where the concentration of Al as metal increases with film thickness and the concentrations of O, Al as oxide and Mo gradually decrease with film thickness. The concentration of oxygen decreases in the depth direction at an average rate of 3.4 at. % per 1 $\mu$m of oxide film thickness. The concentration of Al as metal gradually increases in the depth direction.

Also as shown in FIG. 2, at a thickness ranging from 0 to 0.5 $\mu$m (from 0 to 500 nm) the oxide film has, on average concentrations, 15 at. % Mo, 15 at. % Al as oxide, 20 at. % Mg and 41 at. O, where the concentration of Al as metal gradually increases with increasing depth and has 9 at. % on average, and the concentration of oxygen decreases in depth direction at an average rate of 35 at. % per 1 $\mu$m of oxide film thickness.

Figure 3:
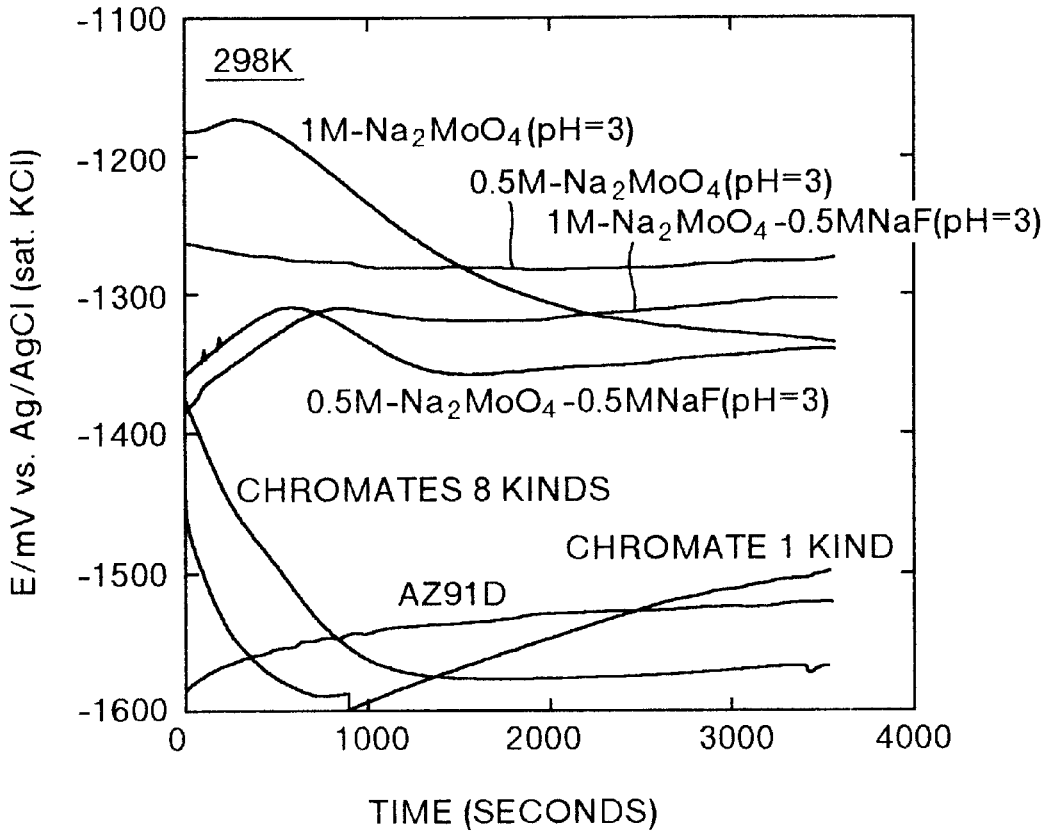
FIG. 3 is a graph showing changes in corrosion potential in time course of the present chemical conversion film and comparative film in 0.01 M $Na_2B_4O_7$ (pH=9.18).
Figure 4:
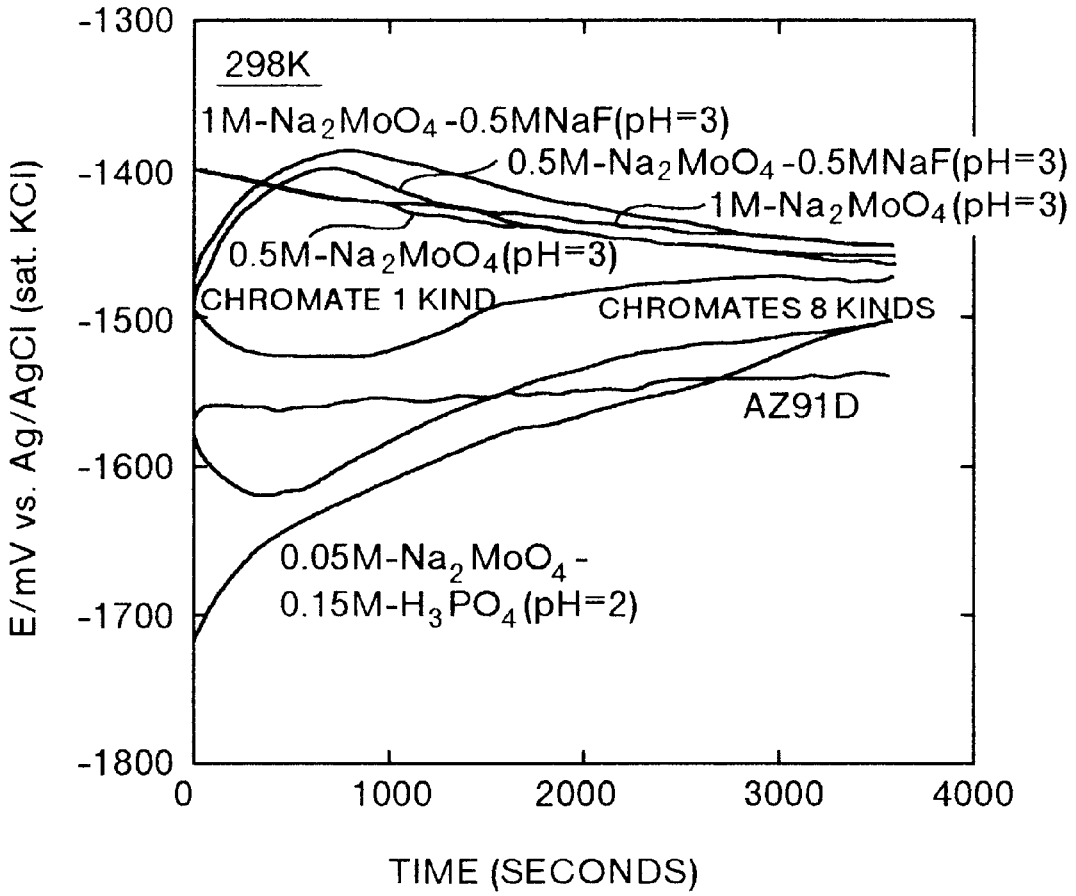
FIG. 4 is a graph showing changes in corrosion potential in time course of the present chemical conversion film and comparative film in 1 M $Na_2SO_4$.

FIG. 3 and FIG. 4 show changes in time course of corrosion potential at 25° C. in 0.01 M $Na_2B_4O_7$ (pH=9.18) and in 1 M $Na_2SO_4$, respectively. Both molybdate conversion films have a higher corrosion potential than those of untreated AZ91D and chromate conversion film and have an equivalent or superior effect of anticorrosive coating to that of the chromate conversion film.

As shown in FIG. 3, the chromate conversion films resulting from the treatment for 30 minutes have base corrosion potentials of not more than −1,500 mV, whereas the present conversion films have a noble corrosion potentials of not less than −1,500 mV, specifically not less than −1,350 mV. By increasing the concentration of the solution for chemical conversion treatment, a much nobler corrosion potential can be evidently obtained.

As shown in FIG. 4, the chromate conversion films resulting from the treatment for 15 minutes have base corrosion potentials of not more than −1,500 mV, whereas the present conversion films have noble corrosion potentials of not less than −1,500 mV, specifically not less than −1,450 mV. By making the concentration of the solution for chemical conversion treatment higher from 0.5 M to 1 M a much nobler corrosion potential can be evidently obtained.

Example 2

In this Example, fluorine-containing, super-water-repellent organic films of the following (1) to (4) were formed as an anticorrosive coat after the chemical 15 conversion treatment of Run No. 1 in Example 1. Test pieces were the same as used in Example 1.

(1) Process using Glass Resine:

50 g of Glass Resine GR650 (commercially available from Showa Denko K.K.) and 5 g of fluorine-based compound of (formula 4) were dissolved into 475 g of 2-butanone and 25 g of ethylene glycol mono-m-butyl ether acetate to prepare a coating agent. A chemical conversion film surface was immersed into the coating agent and then picked up, followed by heating at 160° for 3 hours.

(2) Process using epoxy resin:

5 g of epoxy resin (ED1004) commercially available from Yuka-Shell Epoxy K.K., 3 g of Maruk a Lyncur M (phenol resin commercially available from Maruzen Petrochrmical K.K.). 0.05 g of triethylaminetetraphenyl borate TEA-K (trademark of curing promoter commercially available from Hokko Kagaku K.K.) and 5 g of fluorine-based compound of (formula 5) were dissolved into a solvent mixture consisting 100 g of 2-butanone and 5 g of ethylene glycol mono-n-butyl ether acetate to prepare a coating agent. A chemical conversion film surface was immersed into the coating agent and then picked up, followed by heating at 180° C. for one hour.

(3) Process using epoxy resin and phenol resin:

5 g of epoxy resin (EP1004) commercially available from Yuka-Shell Epoxy K.K., 3 g of Maruka Lyncur M (phenol resin commercially available from Maruzen Petrochemical K.K.) and 0.05 g of triethylaminetetraphenyl borate TEA-K (trademark of curing promoter commercially available from Hokko Kagaku K.K.) were dissolved into a solvent mixture consisting of 100 g of 2-butanone and 5 g of ethylene glycol mono-n-butyl ether acetate to prepare a coating agent. A chemical conversion film surface was immersed into the coating agent and then picked up, followed by heating at 180° C. for one hour. After cooling; the resulting coat was immersed into a solution containing 1 g of a fluorine-based compound of (formula 9) in 100 g of perfluorohexane FC-72 (commercially available from Sumitomo-3M K.K.) for 24 hours and then picked up, followed by heating at 150° C. for 10 minutes.

The members having a fluorine-containing organic film according to the present invention all had maximum contact angles to water of 120° to 130° and also a high water repellency. The fluorine-containing films obtained according to the above (1) and (2) had a better durability than that of those obtained according to the above (3) and (4).

Example 3

Figure 5:
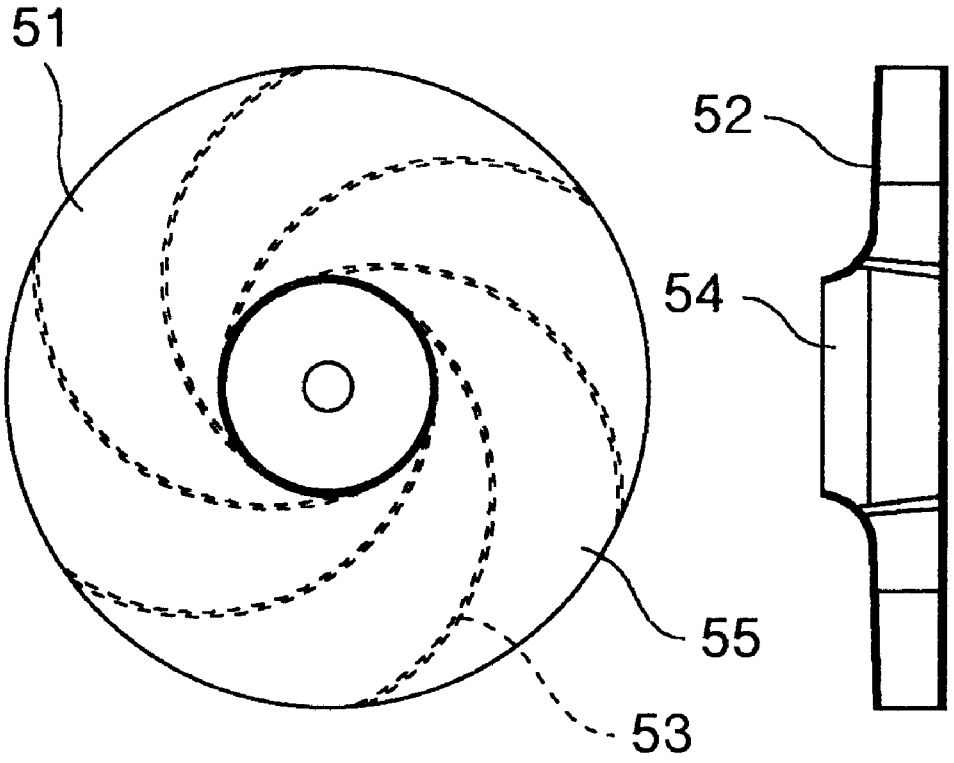
FIG. 5 is a plan view and side view of blade wheel made from Mg alloy AZ91D with anticorrosive coating according to the present process.

FIG. 5 is a plan view and a side view of a blade wheel made from AZ91D by die casting and thixomolding, the blade wheel being provided with an anticorrosive coating according to the present process.

In FIG. 5, numeral 51 shows a front plate having a suction inlet, 52 a back plate conterposed to and below the front plate 51, and 53 blades provided and caught between the front plate 51 and the back plate. The blades 53 are provided as curved along the surfaces of front plate 51 and back plate 52, as shown in FIG. 5.

The front plate 51, the back plate 52 and the blades form a plurality of air discharge outlets 55. Air is sucked through a suction inlet 54 by rotation of the blade wheel and discharged through the air discharge outlets 55. As will be described later, a fear of corrosion of AZ91D was overcome by applying thereto the same anticorrosion coating according to the present invention as the foregoing Examples 1 and 2.

Figure 6:
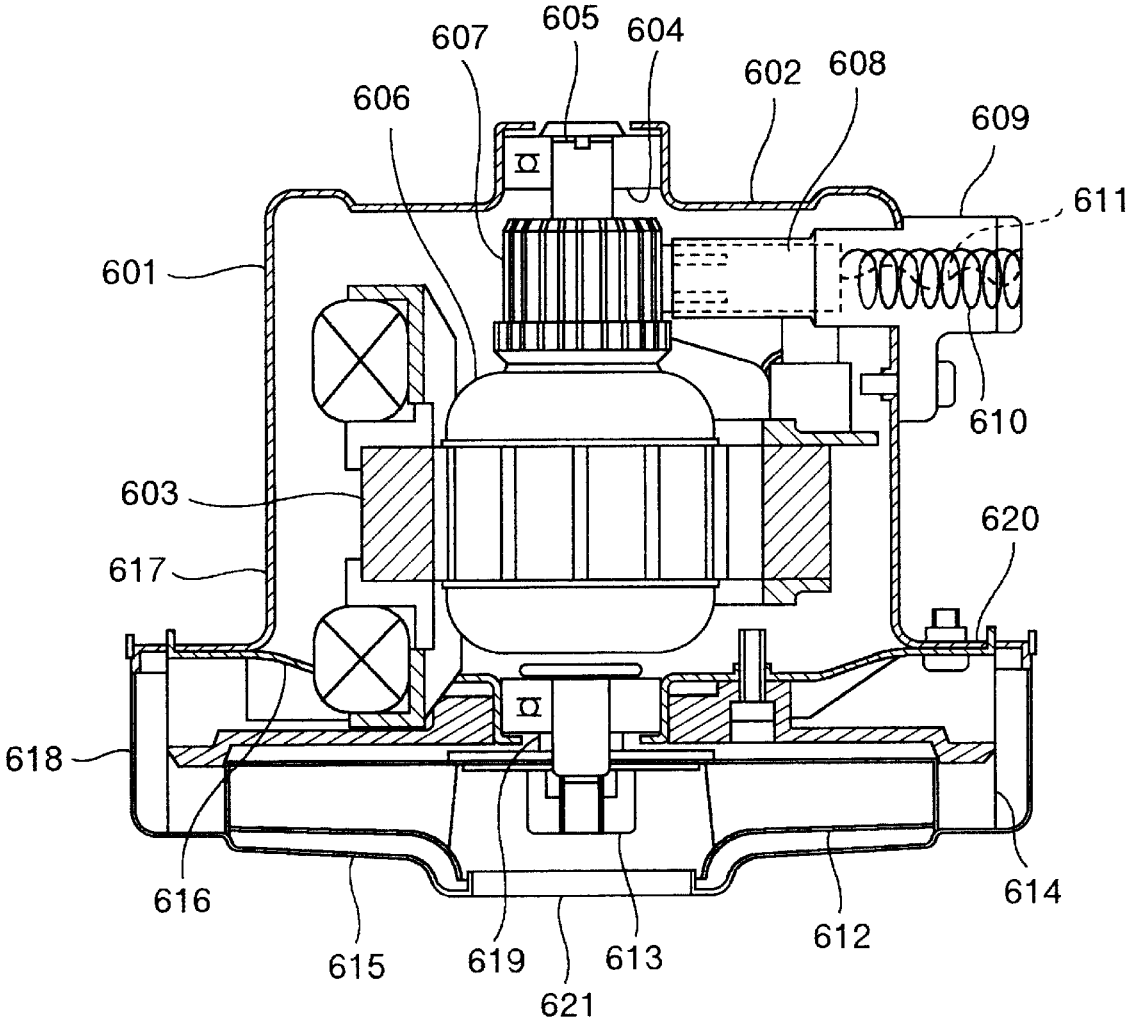
FIG. 6 is a cross-sectional view of electrically driven blower using the present blade wheel.

FIG. 6 is a schematic view of an electrically driven blower using the blade wheel of FIG. 5. Electrically driven blower 601 comprises a motor 617 and a blower 618. Motor 617 comprises a housing 602, a stator 603 fixed to the housing 602, a rotating shaft 605 supported by bearings 604 and 619 provided on the housing 602, a rotor 606 fixed to the rotating shaft 605, a commutator at or 607 fixed to the rotating shaft 605, a brush conducting an electrical connection to the commutator 607, and a holder 609 for holding and fixing the brush 608 to the housing 602.

Commutator 607 has commutator bars on its peripheral surface and each of the commutator bars is connected to a coil in the rotor 606.

Brush 608 is encased in the holder 609 and pushed against the commutator 607 by a spring 610, thereby attaining a sliding contact with the commutator 607. Numeral 611 shows a lead wire, which is electrically connected to the brush 608 to connect the brush 608 to an external electrode, and is connected to a terminal (not shown in the drawing) provided on the holder 609. Housing 602 is provided with an end bracket 620, which connects the motor 617 to the blower 618. On the end bracket 620, an air inlet 616 is formed for introducing air from the blower 618 to the motor 617. Furthermore, the end bracket 620 is provided with stationary guide blades 614, and on its upstream side a blade wheel 612 is fixed to the rotating shaft 605 by a nut 613. A suction inlet 621 is formed at the center of a fan casing fixed to the outer periphery of end bracket 620 by pressure insertion.

When the motor 617 starts to rotate, the rotor 606 rotates and also the blade wheel 612 coaxially provided on the rotor 606 rotates. By rotation of blade wheel 612 air flows in through the suction inlet 621 of fan casing 615, passes through the blade wheel 612 and the stationary guide blades 614 and discharged through the air inlet 616 towards the motor 617.

Figure 7:
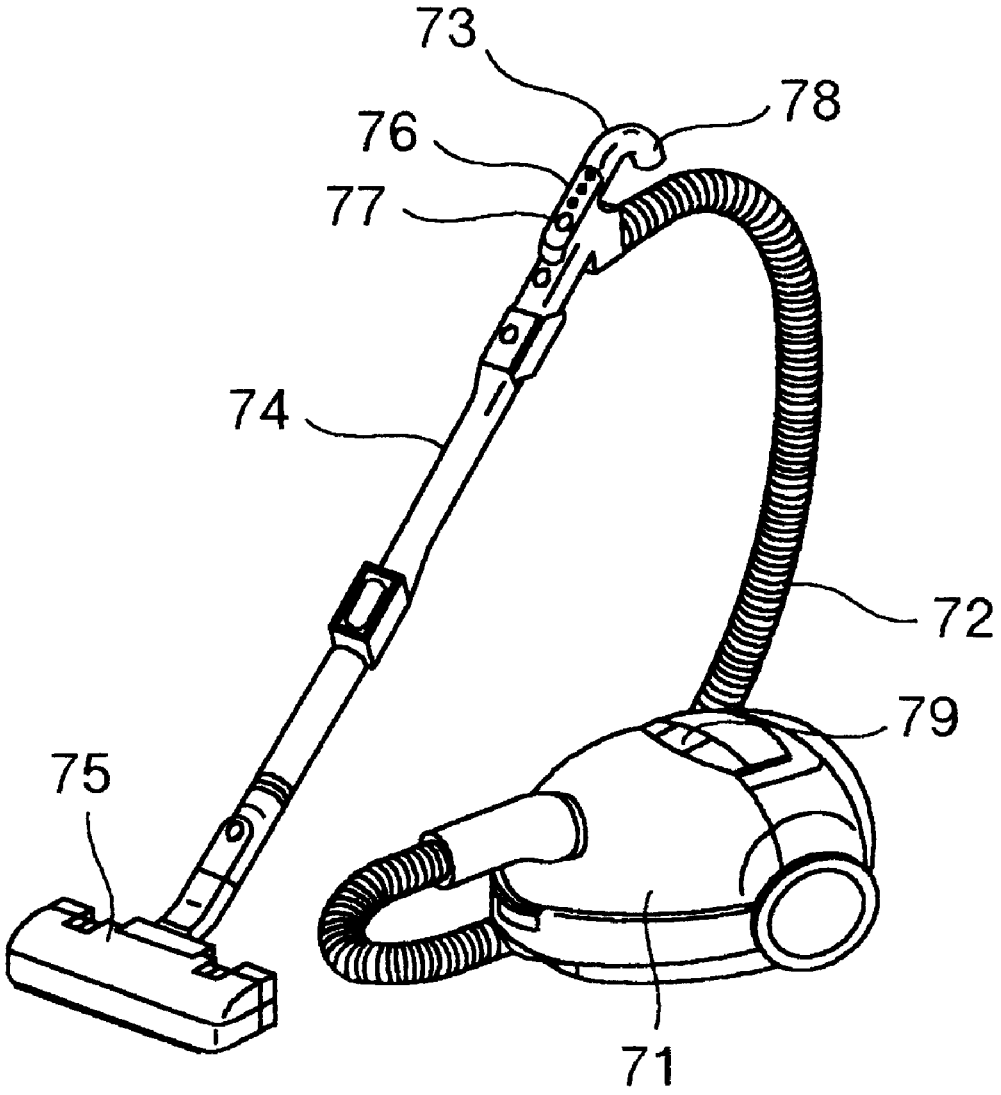
FIG. 7 is a perspective view of electric cleaner encasing the electrically driven blower.

FIG. 7 is a perspective view of appearance of an electric cleaner incasing the electrically driven blower of FIG. 6.

In FIG. 7, numeral 71 shows a cleaner body encasing a control circuit, an electrically driven blower, etc., 72 a hose connected to the suction inlet of cleaner body 71, 73 a hose grip part, 74 an extension tube connected to the tip end C hose grip part of hose 72, 75 a suction inlet body connected to the extension tube 74, 76 a switch-manipulating part provided at the hose grip part 73, 77 a first infrared emission part provided at the hose grip part 73, 78 a second infrared emission part provided at the hose grip part 73, and 79 an infrared receptor provided on the upper surface of cleaner body.

The blade wheel for use in the present invention will be described in detail below.

Figure 8:
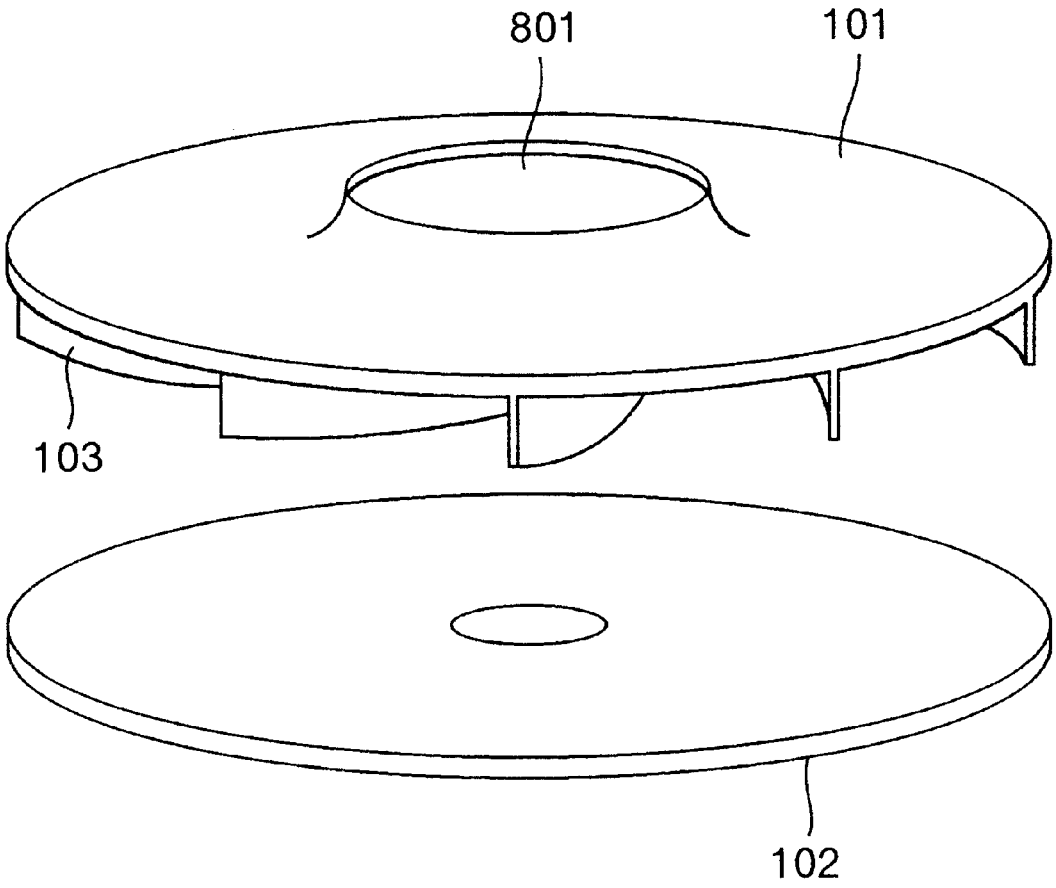
FIG. 8 is a exploded perspective view of the present blade wheel.

FIG. 8 is an exploded perspective view of a blade wheel according to one embodiment of the present invention.

In FIG. 8, a front plate 101 and blades 103 are integrally formed.

In this Example, the integrally formed front plate 101 and blades 103 are made from AZ91D magnesium alloy, but an AM60B magnesium alloy comprising 5.5–6.5 wt. % aluminum, 0.23 wt. % zinc and 0.24–0.6 wt. % manganese according to us ASTM code can be used.

Magnesium alloy has a specific gravity (g/cm$^3$) of about 1.8 and thus can make the weight lighter by about ⅔than aluminum alloy having a specific gravity of 2.7.

A process for bonding the back plate 102 to the blades 103 integrally formed with the front plate will be described in detail below.

Back plate 102 is made from an aluminum alloy of Al—Mg series according to JIS-A5052 and is provided with a solder metal layer on the bonding surface in advance. In this Example, zinc is used for the solder metal layer.

In this Example, the Zn layer for soldering is formed on the back plate 102 by electrolytic plating. The electrolytic plating usually comprises ordinary steps, i.e. steps of defecting, water washing, electrolysis, water washing and drying. The solder zinc layer is formed on the bonding surface of back plate 102 by electrolytic plating in a desired electrolytic solution at desired current density and solution temperature for a desired plating time.

Then, the blades 103 integrally formed with the front plate 101 are concentrically counterposed to the back plate 102 having the solder layer, and the blades 103 are bounded to the back plate 102 by soldering the solder layer as a soldering material formed on the back plate 102 at a desired temperature of not more than the melting start temperature of blades 103 and back plate 102 for a desired heating time under no load or while applying thereto such a small pressure as not to substantially cause deformation.

The solder layer melts into the blades 103 and the back plate 102 at the desired temperature for the desired heating time to form a reaction layer, thereby strongly bonding the blades 103 to the back plate 102.

In this Example, the blades 103 and the back plate 102 are fixed to each other by soldering, and thus no projections for fastening to fix the blades 103 exist on the lower surface of the back plate 102, and thus air resistance under the lower surface of the back plate 102 can be reduced as well as on over the upper surface of front plate 101.

The solder layer onto the back plate 102 is formed by electrolytic plating in this Example, but any or a combination of physical and chemical vapor deposition, ion plating and thermal spraying may also be used.

Furthermore, zinc is used for the solder metal layer in this Example, but low melting metal elements such as tin and lead and low melting alloys containing these elements as the main component may be also used.

Desirable low melting alloys for this purpose include, for example, alloys of zinc-tin series, zinc-lead series, tin-lead series, zinc-magnesium series and zinc-aluminum series.

In this Example, an aluminum alloy according to JIS-A-5052 is used for the back plate 102, but any of alloys of Al—Mn series (3000 series), alloys of Al—Si series (4000 series), alloys of Al—Cu—Mg series (2000 series), alloys of Al—Mg—Si series (6000 series), alloys of Al—Zu—Mg series (7000 series) according to JIS code may be used.

Furthermore, in the blade wheel 712 of this Example a magnesium alloy is used for the front blade 101 and the blades 103 and an aluminum alloy having a larger specific gravity than that of the magnesium alloy is used for the back plate 102. The back plate 102 is made to take the nearer position to the motor, thereby making vibration of rotating shaft due to the unbalanced rotation of the motor rotating shaft smaller, reducing the generating noise and carbon bruck wear-out and increasing the electrically driven blower life.

In this Example, an aluminum alloy is used for the back plate 102, but the same magnesium alloy as used for the front plate 101 and the blades 103 can be also used for the back plate 102.

After the foregoing bonding, the entire blade wheel is heated to the temperature of a solution for chemical conversion treatment and immersed into the solution for chemical conversion treatment to form an oxide film on the parts made from Mg alloy as i n Example 1. The parts made from the Al alloy undergo chemical conversion by the treatment f or the same time but by elevating the chemical conversion treatment temperature to 90° C.

Example 4

Figure 9:
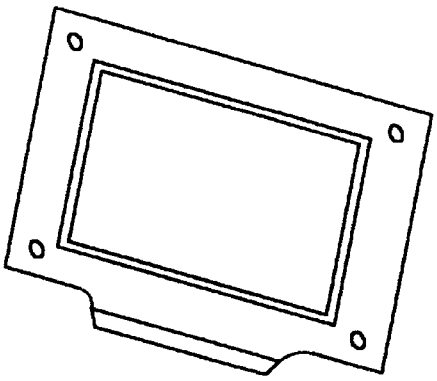
FIG. 9 is a perspective views of various cases for a notebook-type personal computer made from Mg alloy AZ91D with anticorrosive coating according to the present invention.
Figure 9:
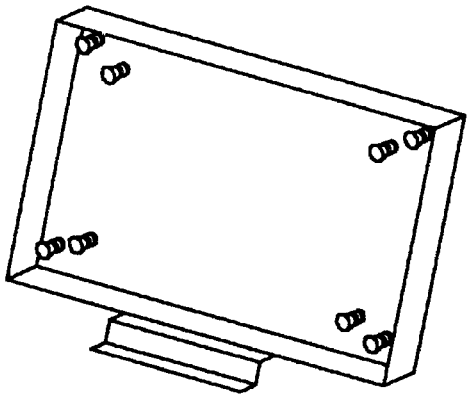
Figure 9:
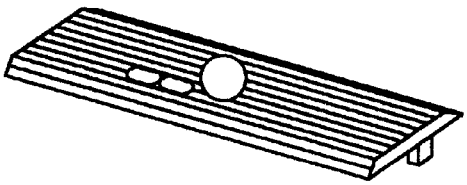
Figure 9:
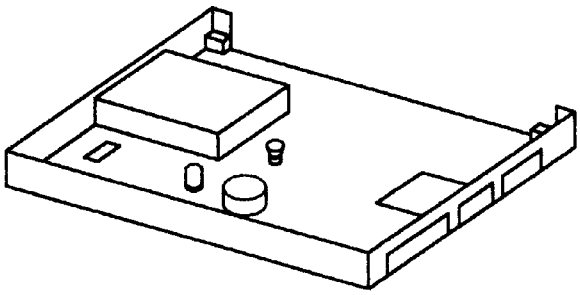

FIG. 9 shows examples of various cases made from anticorrosion film coated AZ91D for a notebook type personal computer, where the display cover and the case are cases for protecting and fixing the display, respectively, the palm rest is a case for keyboard and the bottom case is a case at the bottom. Process and apparatus for producing these various cases will be described in detail below.

Figure 10:
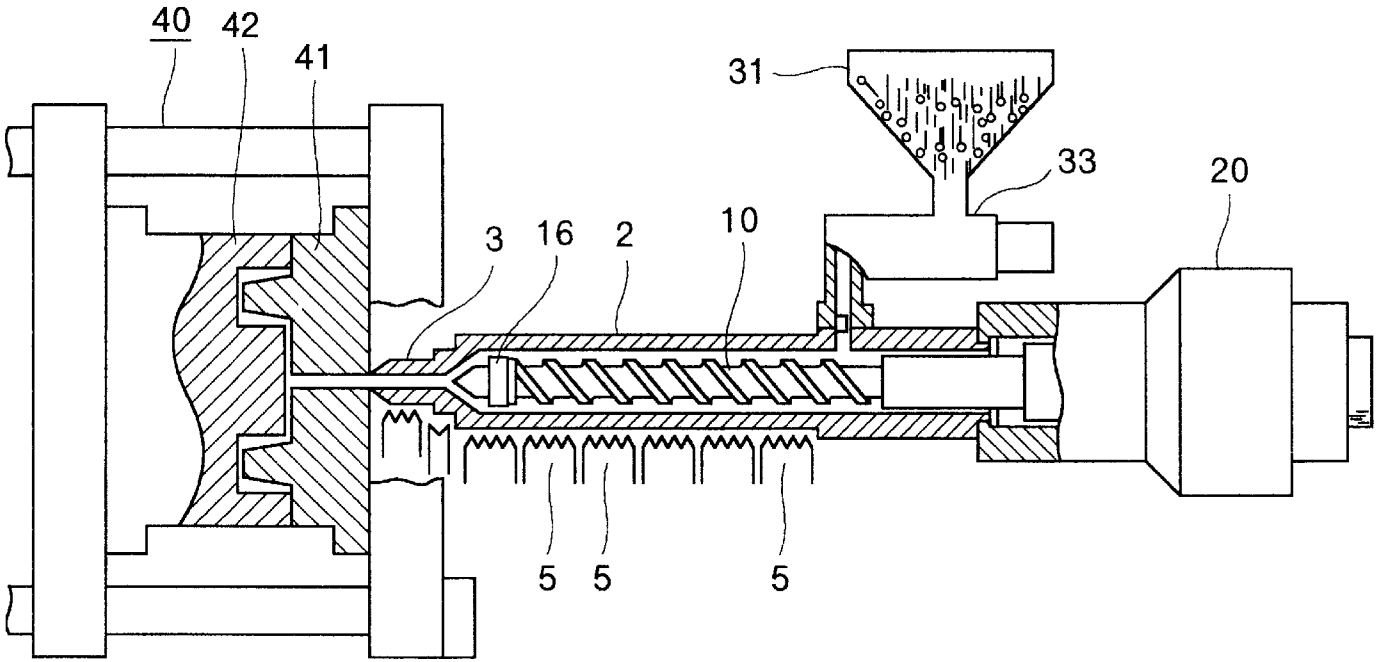
FIG. 10 is a cross-sectional view of thixomolding apparatus.

FIG. 10 is a cross-sectional view of a reciprocal motion screw injecting molding machine suitable for use in the process for producing cases of the present invention. Steps of molding process in a reciprocal motion screw injection molding machine with a liquid pressure clamp is as follows:

1. Feed Mg alloy crushed to a chip state to a hopper 31.

2. Mg alloy is supplied to screw 10 from the hopper 31 by rotation of screw 10 and sheared Mg alloy is heated by a heater 5 while passing through the injection molding machine. Heating temperature can be attained also by the heat of friction by screw 10 and Mg alloy can be maintained at a temperature permitting coexistence of liquid phase and solid phase. By rotation of screw 10 at that temperature $\mu$ primary crystals are formed, but the alloy following the injection molding is in a granular crystal state without any dendrite structure. Particularly, the $\mu$ primary crystals of AZ91D alloy have a particle size of 50 to 100 $\mu$m on average. The resulting structure is a dispersion of supersaturated solid solution a and intermetallic compound $\beta$ having a grain size of not more than 20 $\mu$m in the matrix.

That is, the thixomolding process of this Example comprises (a) feeding magnesium or magnesium alloy having a dendrite crystal structure to the screw extruder, followed by heating at a temperature of not less than the solidus line and not more than the liquidus line of magnesium or magnesium alloy, and (b) subjecting the heated metal or alloy to a shearing action enough to break at least a portion of the dendrite crystal structure of the metal or the alloy by the screw extruder, thereby forming a metal or alloy composition of liquid-solid.

With the tip end of screw 10 being made to serve as a meter 3, the feed rate to mold 40 is metered, and the Mg alloy in a semimolten state, where the solid and the liquid are stirred, is injected from extruder 12 all at once. In FIG. 10, numeral 2 shows a cylinder, 3 a nozzle, 16 a back flow arrester, 20 a driving means, 33 a raw material feeder, 41 a movable mold and 42 a stationary mold.

The Mg alloy of this Example is subjected, as in the cast state, to any of a solution treatment or the solution treatment followed by an artificial aging, and then a chemical conversion oxide film and a super-water-repellent organic film of Examples 1 and 2 are formed thereon, successively. It is preferable to conduct the solution treatment at a temperature of 400° to 500° C. and the artificial aging at a temperature of 130° to 260° C.

According to the present invention, weight can be made lighter and the thickness can be made smaller by using anticorrosion film-coated AZA91D.

Example 5

The following various products were produced according to the thixomolding process as in Example 4, using alloys selected from Mg alloys shown in the following Table 2 (wt. %) and then further subjected to the above-mentioned solution treatment and artificial aging, when required, and then to blasting to remove oxide scales from the surfaces, followed by defatting and chemical conversion treatment as in the Example. In this Example, highly anticorrosive films were obtained as in the foregoing Example 1. As a result of the formation of various super-water-repellent organic films as shown in Example 2 after the application of the present chemical conversion treatment, a higher durability could be obtained. In Table 2, Run Nos. 1 to 7 are used mainly as plastic molding materials as alloy plates, alloy bars, extrusion molding materials, whereas Run Nos. 8 to 14 are suitable to casting.

Other uses of the Mg alloy member of the present invention are listed below.

(1) Digital video camera case, (2) Upper cover for single-lens reflex camera, (3) Upper, lower and back covers for compact camera, (4) Case for MD player, (5) Head arm for hard disc drive (HDD), (6) Automobile sheet parts, steering wheel, piston parts, (7) Television case, (8) Portable telephone case, and (9) Cases for various electrically driven tools.

TABLE 2

| Run No. | Al | Zn | Zr | Mn | Fe |
|---|---|---|---|---|---|
| 1 | 2.5–3.5 | 0.5–1.5 | — | 0.15 or more | 0.010 or less |
| 2 | 5.5–7.2 | 0.5–1.5 | — | 0.15–0.40 | 0.010 or less |
| 3 | 7.5–8.7 | 0.2–1.0 | — | 0.10–0.40 | 0.010 or less |
| 4 | — | 0.8–1.5 | 0.40–0.8 | — | |
| 5 | — | 2.5–4.0 | 0.40–0.8 | — | |
| 6 | — | 4.8–6.2 | 0.45–0.8 | — | |
| 7 | 1.5–2.4 | 0.50–1.5 | — | 0.05 or more | 0.010 or less |
| 8 | 5.3–6.1 | 2.5–3.5 | — | 0.15–0.6 | — |
| 9 | 8.1–9.3 | 0.40–1.0 | — | 0.13–0.5 | — |
| 10 | 8.3–9.7 | 1.6–2.4 | — | 0.10–0.5 | — |
| 11 | 9.3–10.7 | 0.30 or less | — | 0.10–0.5 | — |
| 12 | — | 3.6–5.5 | 0.50–1.0 | — | |
| 13 | — | 5.5–6.5 | 0.60–1.0 | — | |
| 14 | — | 2.0–3.1 | 0.50–1.0 | — | |
| Si | Cu | Ni | Ca | Others | Mg |
| 0.10 or less | 0.10 or less | 0.006 or less | 0.04 or less | — | Balance |
| 0.10 or less | 0.10 or less | 0.006 or less | — | — | Balance |
| 0.10 or less | 0.05 or less | 0.006 or less | — | — | Balance |
| — | 0.03 or less | 0.006 or less | — | — | Balance |
| — | 0.03 or less | 0.006 or less | — | — | Balance |
| — | 0.03 or less | 0.006 or less | — | — | Balance |
| 0.10 or less | 0.10 or less | 0.006 or less | — | — | Balance |
| 0.30 or less | 0.10 or less | 0.01 or less | — | — | Balance |
| 0.30 or less | 0.10 or less | 0.01 or less | — | — | Balance |
| 0.30 or less | 0.10 or less | 0.01 or less | — | — | Balance |
| 0.30 or less | 0.10 or less | 0.01 or less | — | — | Balance |
| — | 0.10 or less | 0.01 or less | — | — | Balance |
| — | 0.10 or less | 0.01 or less | — | Balance | |
| — | 0.10 or less | 0.01 or less | — | RE 2.5–4.0 | Balance |

According to the present invention, an oxide film containing heavy metal ions having a plurality of valencies and enriched particularly in Al originating from the substrate can be formed on the surface of Al-containing Mg alloy by chemical conversion treatment in the solution, thereby providing a coated substrate having a distinguished corrosion resistance. Such an oxide film can be formed without using environmentally harmful substances.

By further applying the ordinary anticorrosive coating or super-water-repellent coating to the oxide film, the film can be given a more distinguished anticorrosive coating.

Furthermore, when Mg alloy is used in various products such as the blade wheel of electrically driven blower, cases for note-type, personal computers, televisions and audio systems of household electrical appliances, etc., automobile parts, etc., their weights can be made lower by forming the present anticorrosive film thereon and its further coating, and their corrosion resistance can be made higher thereby.

What is claimed is:

1. A Mg alloy member, characterized in that a Mg alloy has an oxide film comprising 15 to 35% of Mg by atom and 5 to 20% of Mo by atom on the surface, and wherein the Mo comprises ions that have a plurality of valencies.

2. A Mg alloy member, characterized in that a Mg alloy has an oxide film comprising 15 to 35% of Mg by atom and 5 to 20% of Mo by atom and not more than 30% of Al by atom on the surface, and wherein the Mo comprises ions that have a plurality of valencies.

3. A Mg alloy member, characterized in that a Mg alloy has an oxide film comprising 15 to 35% of Mg by atom and 5 to 20% of Mo by atom and 10 to 30% of Al as an oxide by atom and not more than 15% of metallic Al by atom on the surface, and wherein the Mo comprises ions that have a plurality of valencies.

4. A Mg alloy member, characterized in that a Mg alloy has a noble oxide film with a corrosion potential of not less than −1,500 mV after immersion in an aqueous 0.01 M $Na_2B_4O_7$ solution at a pH of 9.18 and 25° for 30 minutes on the surface.

5. A Mg alloy member, characterized in that a Mg alloy has a noble oxide film with a corrosion potential of not less than −1,500 mV after immersion in an aqueous 1 M $Na_2SO_4$ solution at 25° C. for 15 minutes on the surface.

6. A Mg alloy member, characterized in that a Mg alloy has an oxide film on the surface and a fluorine-containing super-water-repellent organic film on the film.

7. A Mg alloy member characterized in that the fluorine-containing film is a film comprising a compound of the following general formula (1) and an organic polymer:

$$\text{Rf-A-X-B-Y} \quad (1)$$

wherein Rf is a perfluoropolyoxyalkyl group or a perfluoroalkyl group; A and B are independently an amido group, an ester group or an ether group;

X is any one of 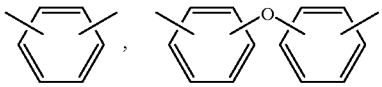

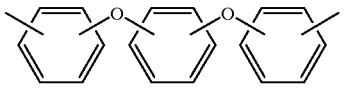

and

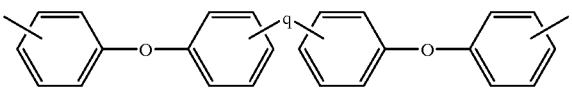

(q is 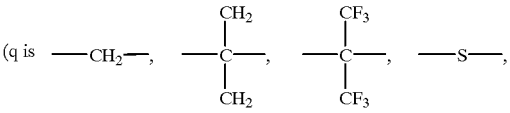

$SO_2$ or direct bond); and Y is

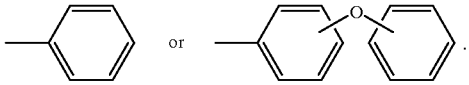

8. A Mg alloy member characterized in that a Mg alloy has an oxide film comprising 15 to 35% of Mg by atom and 5 to 20% of Mo by atom on the surface, and wherein the oxide film has a fluorine-containing super-water-repellent organic film thereon, characterized in that the fluorine-containing film is a film comprising a compound of the following general formula (2):

$$\text{Rf-A-R-Si}—(—OC_nH_{2n+1})_3 \quad (2)$$

wherein Rf is a perfluoropolyoxyalkyl group or a perfluoroalkyl group; A is an amido group, an ester group or an ether group; R is an alkylene group; and n is 1 or 2.

9. An electrically driven blower which comprises a motor encased in a housing, wherein the motor has a rotating shaft, a blade wheel fixed to the rotating shaft of the motor, stationary guide blades provided against the flow passage end of the blade wheel and a fan casing housing the blade wheel and the stationary guide blades, characterized in that the blade wheel is composed of a Mg alloy member having an oxide film thereon, the oxide film comprising 15 to 35% of Mg by atom and 5 to 20% of Mo by atom on the surface, and wherein the Mo comprises ions that have a plurality of valencies.

10. An electrically driven blower which comprises a motor encased in a housing, wherein the motor has a rotating shaft, a blade wheel fixed to the rotating shaft of the motor, stationary guide blades provided against the flow passage end of the blade wheel and a fan casing housing the blade wheel and the stationary guide blades, characterized in that the blade wheel comprises a front plate, a back plate counterposed to the front plate and a plurality of blades provided between the front plate and the back plate, at least one of the front plate and the back plate being integrated with the blades, and is composed of a Mg alloy member having an oxide film on the surface, the oxide film comprising 15 to 35% of Mg by atom and 5 to 20% of Mo by atom on the surface, and wherein the Mo comprises ions that have a plurality of valencies.

11. A Mg alloy member according to any one of claims 1, 2, 3–5, characterized in that the oxide film has a fluorine-containing super-water-repellent organic film thereon.

12. A Mg alloy member according to claim 9 or 10, characterized in that the perfluoropolyoxyalkyl group has a chain of repetition units of oxyalkylene represented by the following structural formula (3), (4) or (5) alone or in combination:

$$—(—CF_2—O—)— \quad (3)$$

$$—(—C_2F_4—O—)— \quad (4)$$

$$—(—C_3F_6—O—)— \quad (5).$$

13. A personal computer, characterized by using a casing composed of a Mg alloy member of any one of claims 1, 2, 3–6, 7 and 8.

14. A video camera, characterized by using a casing composed of a Mg alloy member of any one of claims 1, 2, 3–6, 7, and 8.

15. Use of the Mg alloy member of claims 1, 2, 7 and 8 as a case for an electrically driven tool.

16. An electronic instrument, characterized by using a casing composed of a Mg alloy member of any one of claims 1, 2, 3–6, 7 and 8.

* * * * *